US008800454B2

(12) United States Patent
Jones

(10) Patent No.: US 8,800,454 B2
(45) Date of Patent: Aug. 12, 2014

(54) HEIGHT ADJUSTABLE WORK SURFACE SYSTEM

(75) Inventor: Alan J. Jones, Waterloo (CA)

(73) Assignee: Baral Holdings Corp., Kitchener (CA)

( * ) Notice: Subject to any disclaimer, the term of this patent is extended or adjusted under 35 U.S.C. 154(b) by 0 days.

(21) Appl. No.: 13/085,014

(22) Filed: Apr. 12, 2011

(65) Prior Publication Data

US 2011/0247532 A1 Oct. 13, 2011

Related U.S. Application Data

(60) Provisional application No. 61/323,061, filed on Apr. 12, 2010.

(51) Int. Cl.
*A47F 5/12* (2006.01)
*A47B 9/00* (2006.01)

(52) U.S. Cl.
USPC ..... 108/10; 108/145

(58) Field of Classification Search
USPC ..... 108/42, 47, 48, 108, 109, 147.22, 108/144.11, 145, 147, 5, 10
See application file for complete search history.

(56) References Cited

U.S. PATENT DOCUMENTS

| | | | | |
|---|---|---|---|---|
| 2,013,542 | A * | 9/1935 | Nordmark | 108/3 |
| 3,202,392 | A * | 8/1965 | Wallace | 248/455 |
| 4,619,208 | A | 10/1986 | Kurrasch | |
| 4,751,884 | A | 6/1988 | Ball | |
| 4,898,103 | A * | 2/1990 | Pontoppidan et al. | 108/145 |
| 5,108,063 | A * | 4/1992 | Koerber et al. | 248/284.1 |
| 5,370,063 | A | 12/1994 | Childers | |
| 5,649,493 | A | 7/1997 | Blume | |
| 5,823,120 | A | 10/1998 | Holmquist | |
| 5,931,429 | A * | 8/1999 | Hellwig et al. | 248/235 |
| 5,996,961 | A | 12/1999 | Johnson | |
| 6,038,986 | A * | 3/2000 | Ransil et al. | 108/145 |
| 6,336,618 | B1 | 1/2002 | Barber | |
| 6,446,396 | B1 | 9/2002 | Marangoni et al. | |
| 6,474,243 | B1 | 11/2002 | Grohse | |
| 6,691,626 | B2 * | 2/2004 | Warner | 108/145 |
| 7,997,211 | B2 * | 8/2011 | Peterson et al. | 108/42 |
| 8,065,966 | B1 * | 11/2011 | Bacon et al. | 108/145 |
| 2006/0180057 | A1 | 8/2006 | Hallman | |
| 2007/0034754 | A1 | 2/2007 | McKeon | |
| 2007/0266912 | A1 * | 11/2007 | Swain | 108/145 |

FOREIGN PATENT DOCUMENTS

| | | |
|---|---|---|
| WO | 9847407 | 10/1998 |
| WO | 2004097269 | 11/2004 |

OTHER PUBLICATIONS

GCX Corporation, VHM™ Extension / Sliding Laptop Tray Product Information, downloaded from http://www.gcx.com/products/print_kit/950, Mar. 1, 2010.

* cited by examiner

*Primary Examiner* — Darnell Jayne
*Assistant Examiner* — Timothy M Ayres
(74) *Attorney, Agent, or Firm* — Borden Ladner Gervais LLP; Jeffrey W. Wong

(57) ABSTRACT

A height adjustable work surface system having an under-mount mechanism pivotably attached at a first end to a mounting bracket for mounting to a secure structure; the under-mount mechanism being further pivotably attached at a second end to an attachment bracket; the attachment bracket further connected to a work surface support designed to connect to a work surface; and by pivoting the under-mount mechanism from a first to a second position the work surface is raised or lowered.

16 Claims, 10 Drawing Sheets

HEIGHT ADJUSTABLE WORK SURFACE SYSTEM

CROSS-REFERENCE TO RELATED APPLICATIONS

This application claims the benefit of U.S. Provisional Patent Application No. 61/323,061, filed Apr. 12, 2010, which is hereby incorporated by reference in its entirety.

FIELD OF THE DISCLOSURE

The document relates generally to adjustable work surfaces. More particularly, the document relates to a height adjustable work surface system.

BACKGROUND OF THE DISCLOSURE

In the field of traditional support mechanisms, there are many different types of work surface support mechanisms, including adjustable and fixed work surface supports. However, such support mechanisms generally require a large number of individual parts, making it expensive to manufacture or assemble or both. Height adjustable tables and desks are known, but are often stand alone pieces of furniture that are often too expensive to incorporate into an office environment. Also, they are not designed for use in a cubicle or to be attached to a traditional desk. These height adjustable pieces are traditionally electrically powered or hand cranked and may be complicated to use.

It is, therefore, desirable to provide an adjustable work surface support that overcomes some of the disadvantages of the prior art.

SUMMARY OF THE DISCLOSURE

It is therefore desirable to have an adjustable work system, or surface support mechanism for a work surface, which provides a robust support, which can be easily and repeatably raised and lowered, while keeping the construction simple and more cost effective to manufacture and assemble. There is a need for such an adjustable work surface to be mountable to a secure structure, for example, a system wall panel, a modesty panel, a freestanding desk or an office wall.

Adjusting the height and changing the position of the work surface has been shown to provide ergonomic advantages to a user. Giving the user the ability to move the work surface and change from a sitting to standing position or vice versa, may reduce the stiffness the user may encounter after sitting in the same position for several hours of the day and may increase a user's metabolic rate.

In one aspect, a height adjustable work surface system is provided having an under-mount mechanism pivotably attached at a first end to a mounting bracket for mounting to a secure structure; the under-mount mechanism being further pivotably attached at a second end to an attachment bracket; the attachment bracket further connected to a work surface support designed to connect to a work surface; and by pivoting the under-mount mechanism from a first to a second position the work surface is raised or lowered.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Generally, a height adjustable work surface system is disclosed. A primary work surface, such as a flat desk surface may be attached to the height adjustable work surface system. A similar mounting system may be adaptable to be used with a dual work surface system and the following disclosure should not be considered limited to the primary work surface.

The work surface system is attached to a secure structure, for example, a wall panel of a system workstation or a modesty panel of a freestanding desk by way of a mounting bracket. The work surface or desktop surface is attached to an under-mount mechanism of the work surface system, which allows the work surface to be raised and lowered. While the work surface may be raised and lowered, for example, from a sitting to a standing level with respect to the user's perspective, the movement of the work surface toward and away from the secure structure is intended to be minimized. When attached to a system panel, the work surface system is intended to maintain a constant gap from the system's wall panel. In some cases, the constant gap is approximately one inch.

Figure 1:
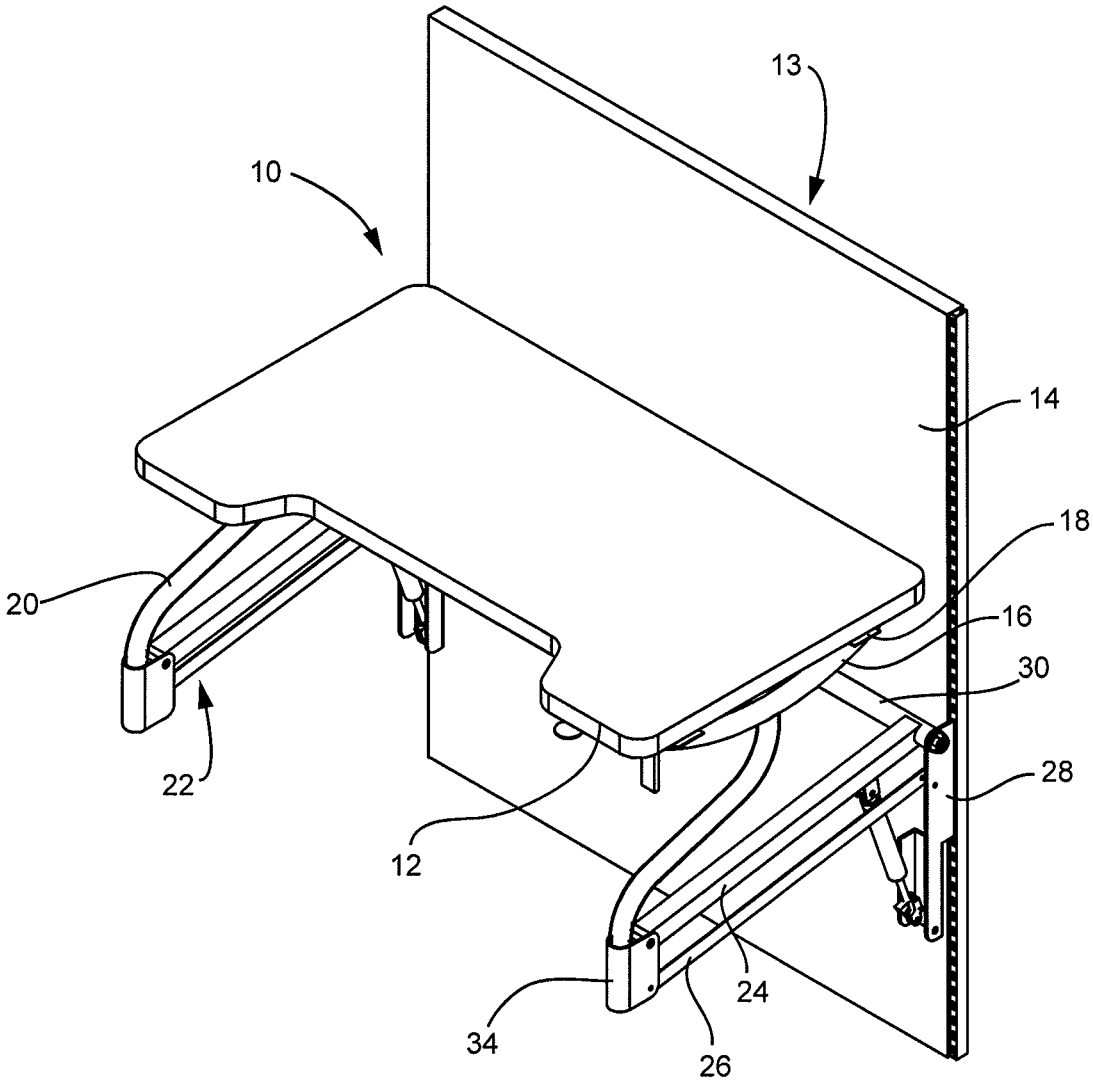
FIG. 1 is a perspective view of an adjustable work surface system attached to a system panel in accordance with an embodiment.

FIG. 1 illustrates a perspective view of a height adjustable work surface system 10. The work surface 12 is a flat or planar surface designed as a working surface for a user. The work surface 12 may contain previously manufactured features such as a monitor stand or stationary holder. In some cases, the work surface may be rectilinear in shape. In other cases, as shown in FIG. 1, there may be a cut out or recessed area at a front side. The corners of the work surface 12 may be rounded to reduce sharp points that may cause injury to a user or may be left at 90 degree angle. Other shapes are contemplated, but preferably, the work surface has a straight back edge, designed to be proximate to a secure structure 13 for example, a system panel 14, wall panel, or desk system back. The back edge of the work surface 12 (assuming the front edge is closest to the user) is designed to maintain a gap between the system panel 14 and the gap is designed to stay relatively minimal yet, for safety reasons, should remain at least 1 inch away from the system panel 14, when the work surface is raised or lowered. This gap may be hidden from the user by a strip of material, preferably pliable, (not shown) against the back of the work surface or by covering the gap. This strip of material may be rubberized or be of sufficiently malleable material.

The work surface 12 is attached to the height adjustable work surface system and may be installed as a separate piece after the manufacture of the work surface system. In an alternative, the work surface 12 may be retrofitted from a previously manufactured fixed desk and attached to the height adjustable work surface system 10.

The work surface 12 may be attached to a work surface support, preferably along its longitudinal side, via rail brackets 18, described in further detail below with reference to FIG. 5, or may be directly attached to the work surface 12, via fasteners, for example bolts, Mirakoshi fasteners, or adhesive. Each work surface support includes a top support 16 which is connected to connector rod 20. The connector rod 20 may be connected to the top support 16 near the middle of the top support 16 via, for example, welding or fasteners such as bolts or screws. In an alternative, the top support and connector rod may be a single integrated piece. The connector rod 20 is preferable curved, as shown in FIG. 1, to connect at its other end to an under-mount mechanism 22 that allows for height adjustability of the work surface 12. The under-mount mechanism 22 is shown as a dual, or parallel, arm mechanism, where one arm may be a support arm 24 while the other arm may be a connector arm 26 providing a parallelogram structure.

The adjustable work surface system 10 is designed to mount to the secure structure such as the system panel 14 or desk structure via mounting brackets, for example panel mounting brackets 28 preferably located on either side of the adjustable work surface system 10 and preferably mounted in a vertical orientation. A support bar or crossbar 30, preferably tubular, is mounted at each end to each of the panel mounting brackets 28. One end of the support arm 24 may be mounted to the crossbar 30 while one end of the connector arm 26 may be mounted to the panel mounting bracket 28. The support arm 24 of the parallel arm mechanism is preferably constructed as a tubular bar, similar to the construction of the crossbar 26. If there is a risk of user contact with either the support arm 24 or the connector arm 26, a round tubular design may be preferred to allow the construction to be user-friendly without having corners or points that could cause injury if the user were to bump up against the support system 10. In the alternative, a square or otherwise shaped tubular bar may be used.

Each dual arm mechanism attaches to the work surface support via an attachment mechanism, such as an attachment bracket 34. Each work surface support extends from its attachment bracket 34 and attaches to the work surface 12, via the top support 16 and connector rod 20. The top support 16 may be aligned on either side edge of the work surface in order to keep the area under the work surface free and clear. Preferably, each connector rod 20 would have a curved construction and may also be formed from a tubular construction to provide smoother edges to reduce the likelihood of injury to a user.

Figure 2:
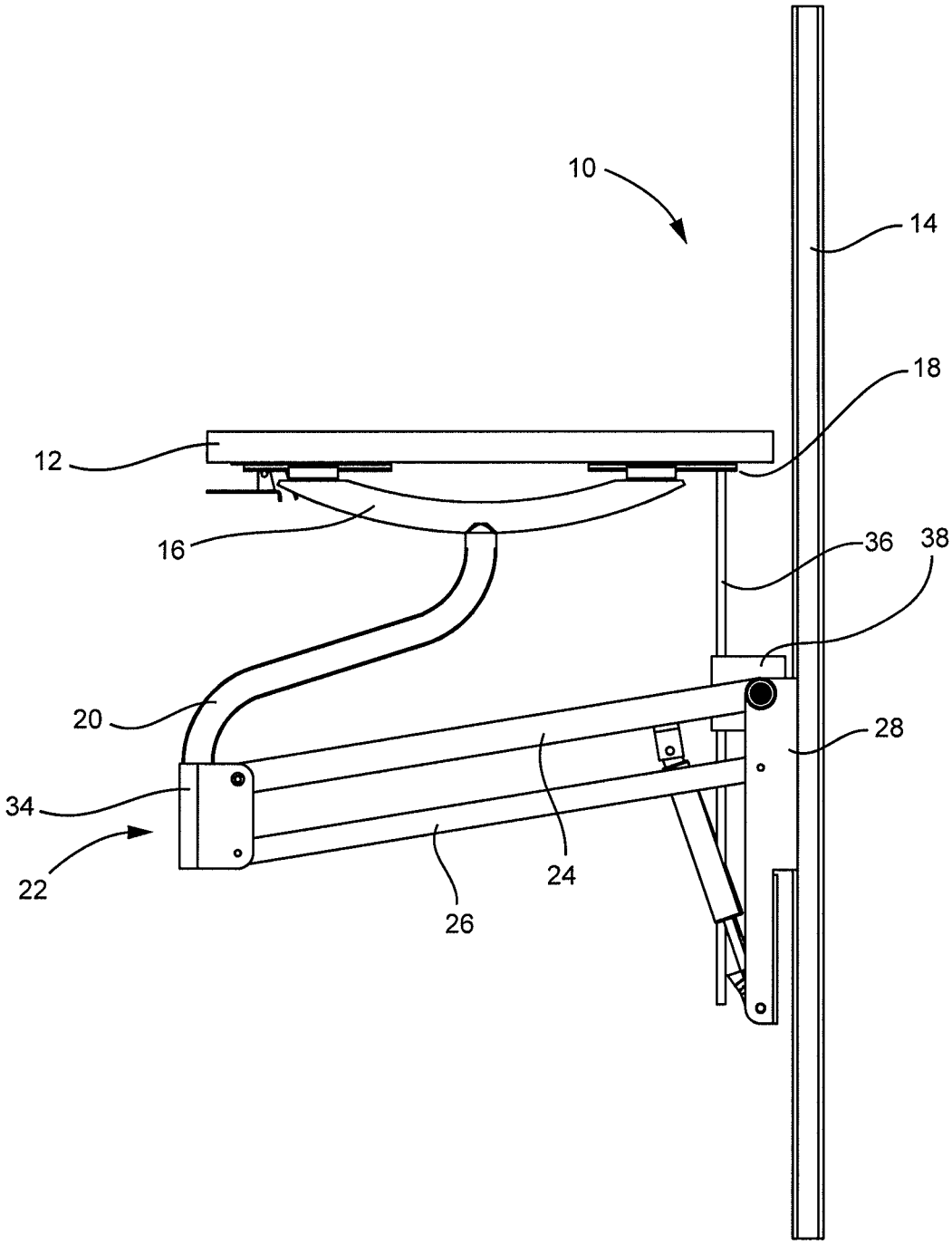
FIG. 2 is a side view of an adjustable work surface system in a middle position.
Figure 3:
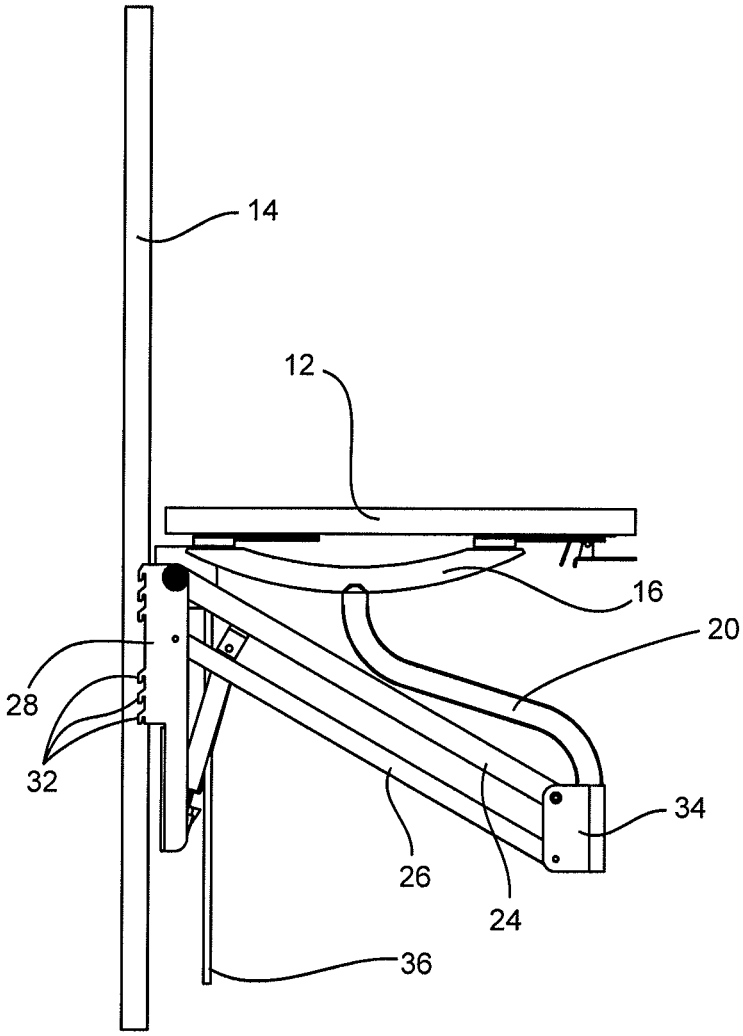
FIG. 3 is a side view of an adjustable work surface system in a lowered position.
Figure 4:
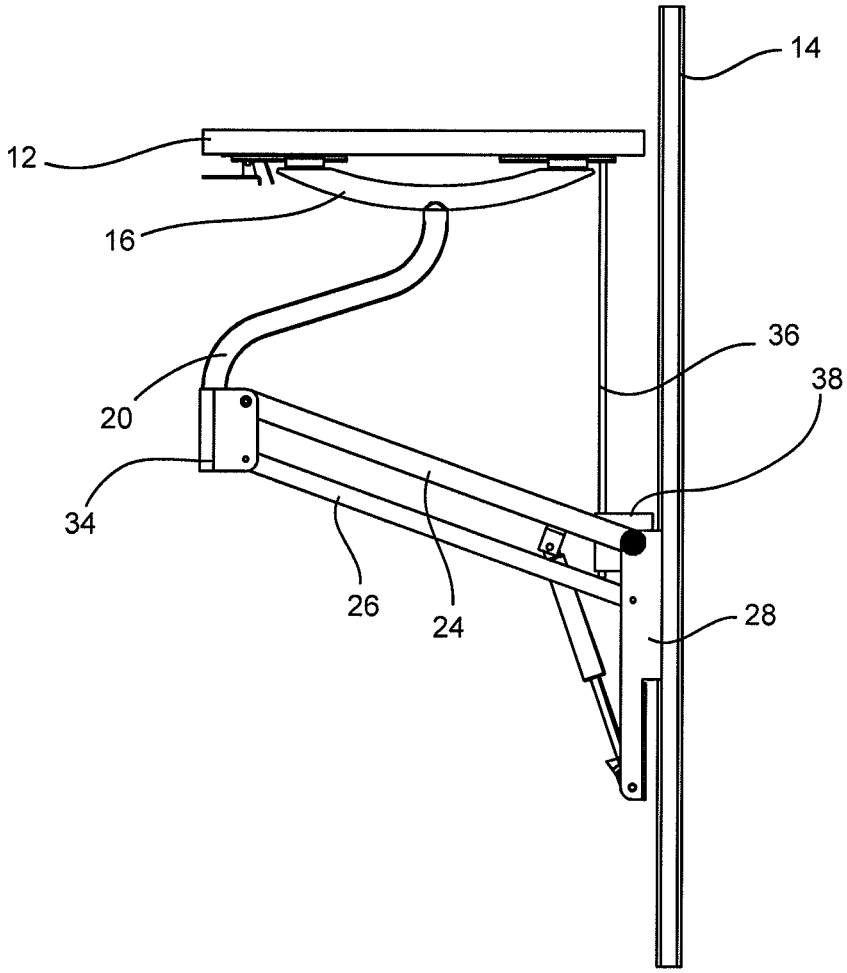
FIG. 4 is a side view of an adjustable work surface system in a raised position.

A further discussion is now provided regarding the parallelism provided by the under-mount mechanism to accomplish the height adjustment of the work surface system. The under-mount mechanism is designed to maintain the work surface in a horizontal or level position, yet allow the work surface to be used at an intermediate or middle position as shown in FIG. 2, or at a lowered position as shown in FIG. 3, or a raised position as shown in FIG. 4. Other positions between the lowered and raised positions are also possible. The under-mount mechanism uses a parallelogram linkage system. The panel mounting bracket 28 is arranged adjacent to one of the dual arm mechanisms. This dual arm or parallel arm mechanism is pivotably attached at a first end to one of the panel mounting brackets 28, via the crossbar 30, and at a second end to the attachment bracket 34, which is located between the connecting arm and the second mounting bracket. A first axis, or pivot point, of the panel mounting bracket 28 and the second axis, or pivot point, of the attachment bracket 34 and the dual arm mechanism form a parallelogram, which allows the arms to move through their respective axes of rotation, while holding the work surface at a constant plane relative to the ground. When the dual arm mechanism is rotated about the first axis, the connector arm translates with the support arm and rotates around the two pivot points. Both under-mount mechanisms 22, on either side of the work surface, provide this parallelogram linkage system. The connector arm 26 is preferably of a similar shape and size as the support arm 24 of the mechanism so the connecting arm does not impede with the movement of the support arm through the first axis of rotation of the support.

As shown in FIGS. 2 to 3, the under-mount mechanism may be operatively connected to a guide 36. The guide 36 may be a bar or rod and is attached to the underside of the work surface via fasteners such as bolts, screws or adhesive. The guide 36 is slideably connected to a guide controller 38. The guide controller 38 is connected to the crossbar 30 and as the work surface 12 is raised and lowered the guide 36 slides through the guide controller, keeping the back of the work surface 12 in a proximate relationship with the system panel 14. The guide 36 and guide controller 38 are designed to allow the change in height of the work surface while limiting its movement in the horizontal direction. In an alternative, the guide 36 may be omitted, which may allow the work surface to have some horizontal movement during the operation of the under-mount mechanism.

The panel mounting brackets 28 may be mounted into provided vertical key slots of the system panel 14 by a clip arrangement that may include hooked teeth 32, shown in more detail in FIG. 3. The top hooked tooth may be oriented in the opposite direction to ensure that the mounting bracket is less likely to become disengaged. Alternatively, all hooked teeth may be oriented in the same direction, as shown in FIG. 3. In another alternative, the clip arrangement may be modified to correspond to slots or apertures located in a wall channel of an office wall partition or cubicle wall. It will be understood that the clip arrangement of the mounting bracket is intended to securely attach the work surface system 10 to the panel system 14.

Figure 5:
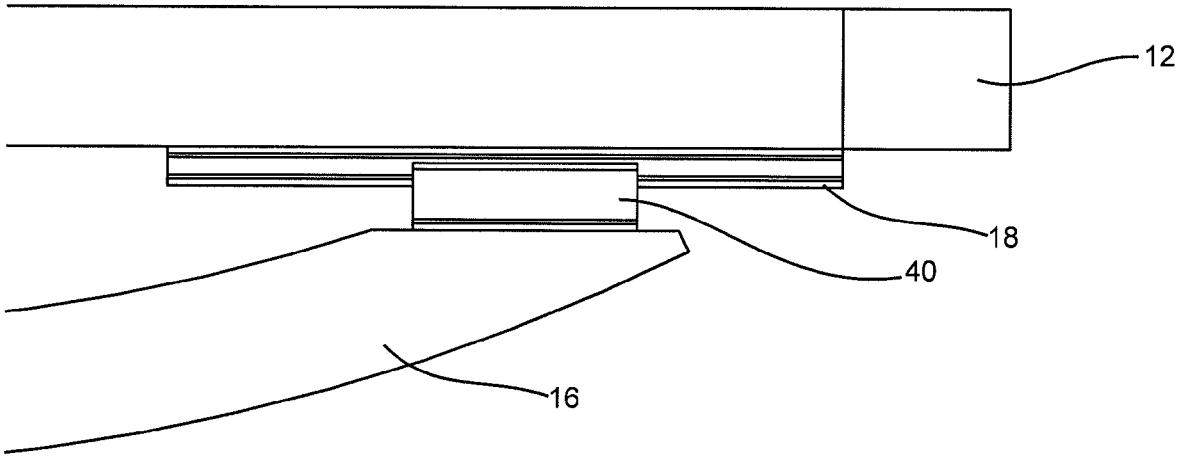
FIG. 5 illustrates a rail bracket for an adjustable work surface system.

In an embodiment, as shown in FIG. 5, attachment apparatus 40, such as clips, are attached to either end of the top support 16. The clips 40 are adapted to engage in a slideable relationship with the rail brackets 18, attached to the underside of the work surface 12, via fasteners for example, bolts, screws or adhesive. This slidability allows for the top support to move during the raising and lowering of the work surface, while the guide 36 maintains the work surface 12 at a relatively consistent distance from the system panel 14. Though not shown in detail, the clips 40 may be Z-shaped or appear as bent projections and are adapted to slide in the rail bracket 18. It will be understood that both the front end and back end of the top support may be attached to similar clips. As the work surface 12 is raised and lowered, the top support 16 is able to slide, which is intended to further limit the horizontal movement of the work surface 12, itself. The movement of the clips 40 with respect to the rail bracket 18 may be seen in the various positions of the adjustable work surface positions shown in FIGS. 2 to 4.

In an alternative, the rail bracket may be adapted to have an aperture designed to receive the clips 40 from top support 16. In this embodiment, the attached apparatus may be a T-shaped projection designed to be received by an aperture in the rail bracket 18.

Figure 6:
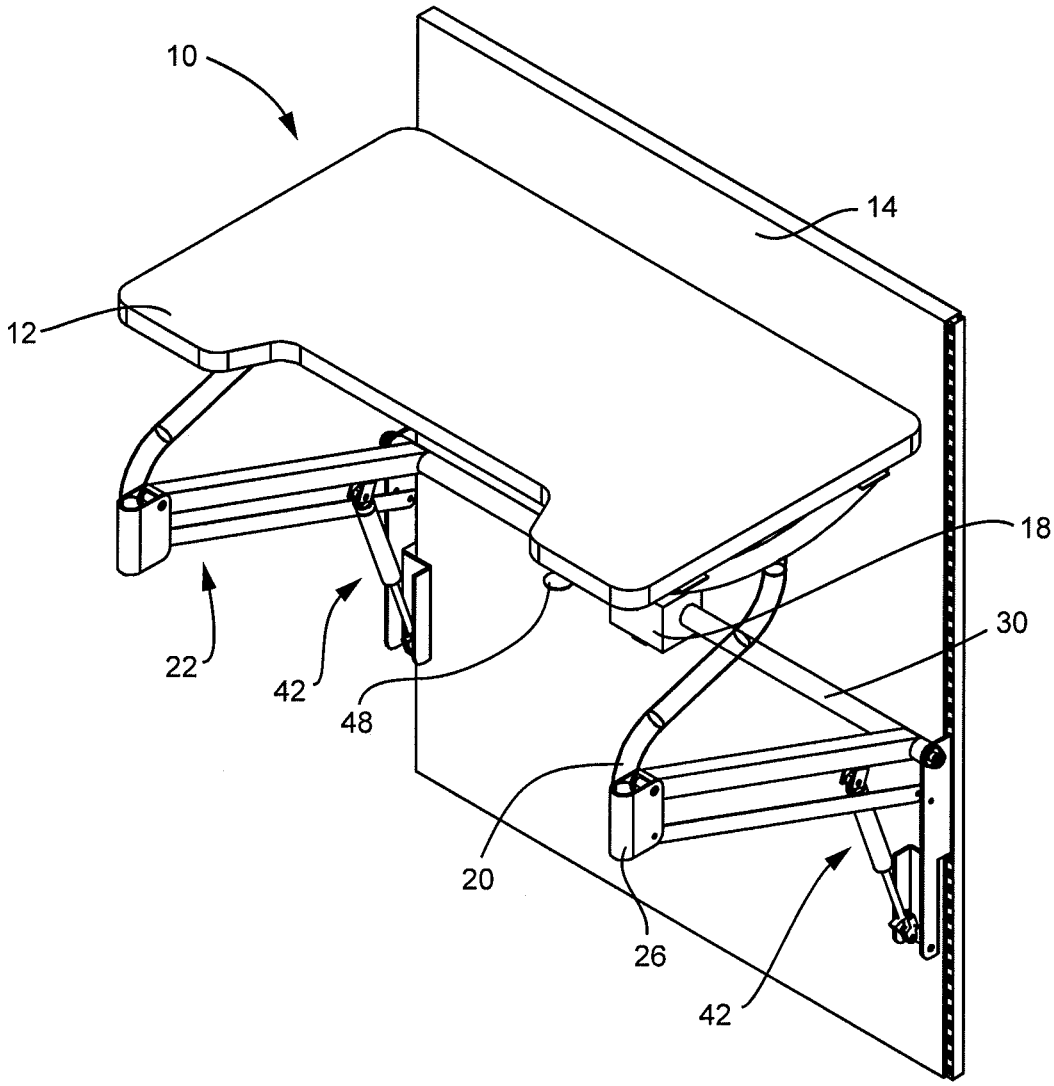
FIG. 6 is a perspective view of an adjustable work surface system in the raised position.
Figure 7:
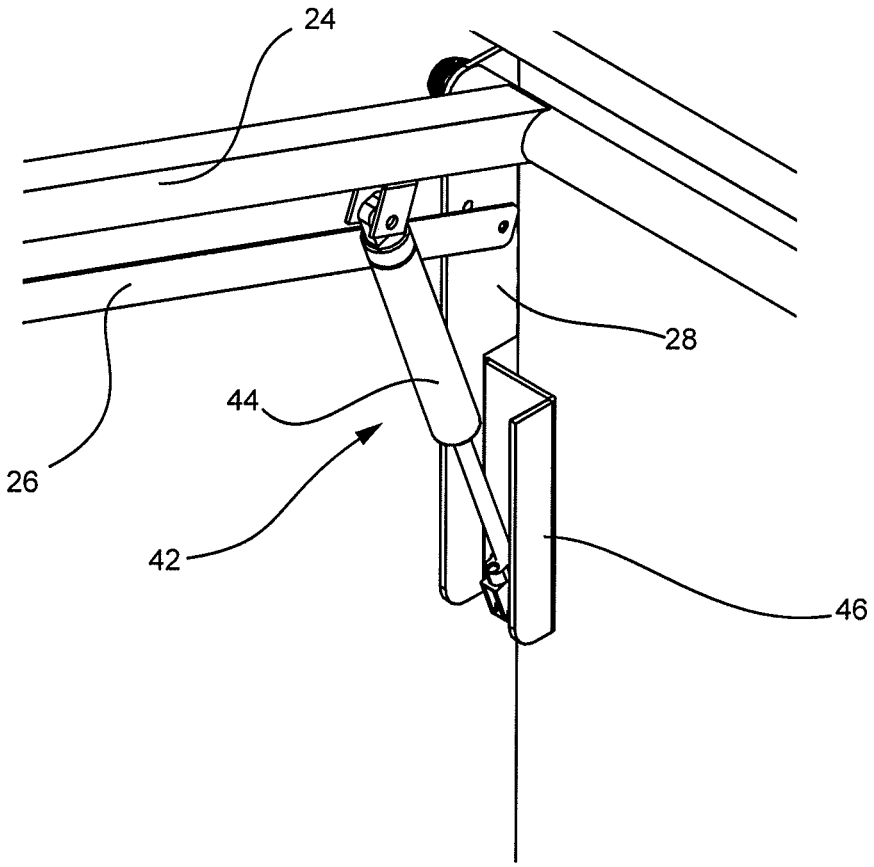
FIG. 7 illustrates a gas lift system for an adjustable work surface system.

The under-mount mechanism may further include a lift system 42 as shown in the perspective view of FIG. 6, and in further detail in FIG. 7. The lift system 42 allows a user to release and lock the position of the work surface at a desired height. The lift system 42 includes a pneumatic or gas lift 44 mounted to the work surface system 10 via a lift bracket 46, which may be an extension to the panel mounting bracket 28 or may be a separate bracket. The gas lift 44 includes a release activation mechanism at one end of the gas lift, which is designed to act as a brake and hold the work surface system 10 in a fixed position. The gas lift 44 is operatively connected to the under-mount mechanism 22, in that the lifting and braking system is attached to at least one arm and aids in the raising and lowering of the work surface 12. The lift system 42 may be attached to either of the support arm 24 or may be attached to both support arms via two gas lifts. Having the lift system 42 attached to both support arms may be preferable as this arrangement reduces the load making it easier for a user to raise and lower the work surface 12. This may also aid in making the work surface 12 raise evenly and remain fixed when locked at a desired height.

Figure 8:
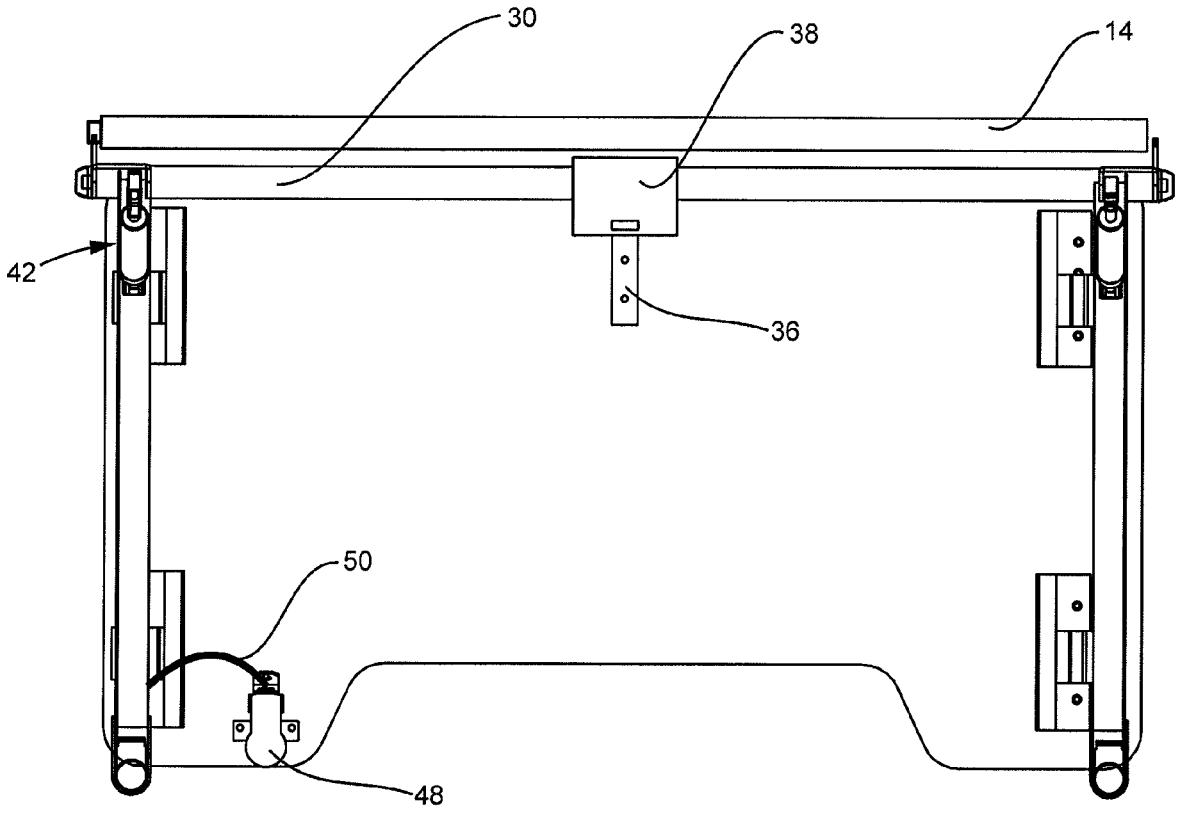
FIG. 8 is a bottom view of an adjustable work surface system.

FIG. 8 illustrates the underside of a work surface system 10. From this angle, a lift system control mechanism 48 of the lift system 42 can be seen. The lift system control mechanism 48 is preferably located near the front of the work surface 12, to allow for easy access to a user. Activating the lift system control mechanism 48 disengages or releases the gas lift 44, allowing the under-mount mechanism to rotate around the first axis. Once the lift system control mechanism 48 is disengaged, the user may raise or lower the work surface 12 to a desired height. When the lift system control mechanism 48 is engaged or locked, the lift system 42 securely holds work surface 12 in a locked position. If the lifting and braking system is included on either side of the work surface, it is preferred to have both lift systems 42 feed to the same lift system control mechanism 48. Alternatively, two lift system control mechanisms may be used and may be located at opposite sides of the work surface 12.

It will be understood that there are many various raised and lowered positions since the user may define the position of the work surface, anywhere along the range of movement. The lift system control mechanism may be a paddle, which is connected to the gas lift 44 via a cable 50. The cable 50 is preferably located within the arms of the work surface support so that it does not interfere with any objects underneath the work surfaces, and avoids entanglement and possible injury to the user's limbs and to protect the cable from being damaged.

In an alternative, the lift system may be a combination of a gas lift 44 in association with at least one spring brake system. In this alternative, a user may activate the brake system by a remote control such as a paddle, as above. As a gas lift is also provided, the user can easily raise or lower the work surface with minimal effort. The remote control mechanism is designed to engage and disengage the spring brake in order to lock or unlock the position of the work surface. Although it is preferred to have a spring brake on either side, only one remote and paddle system may be necessary to control the overall lift system. Other lift and/or brake mechanisms, which are contemplated, may also be possible.

Figure 9:
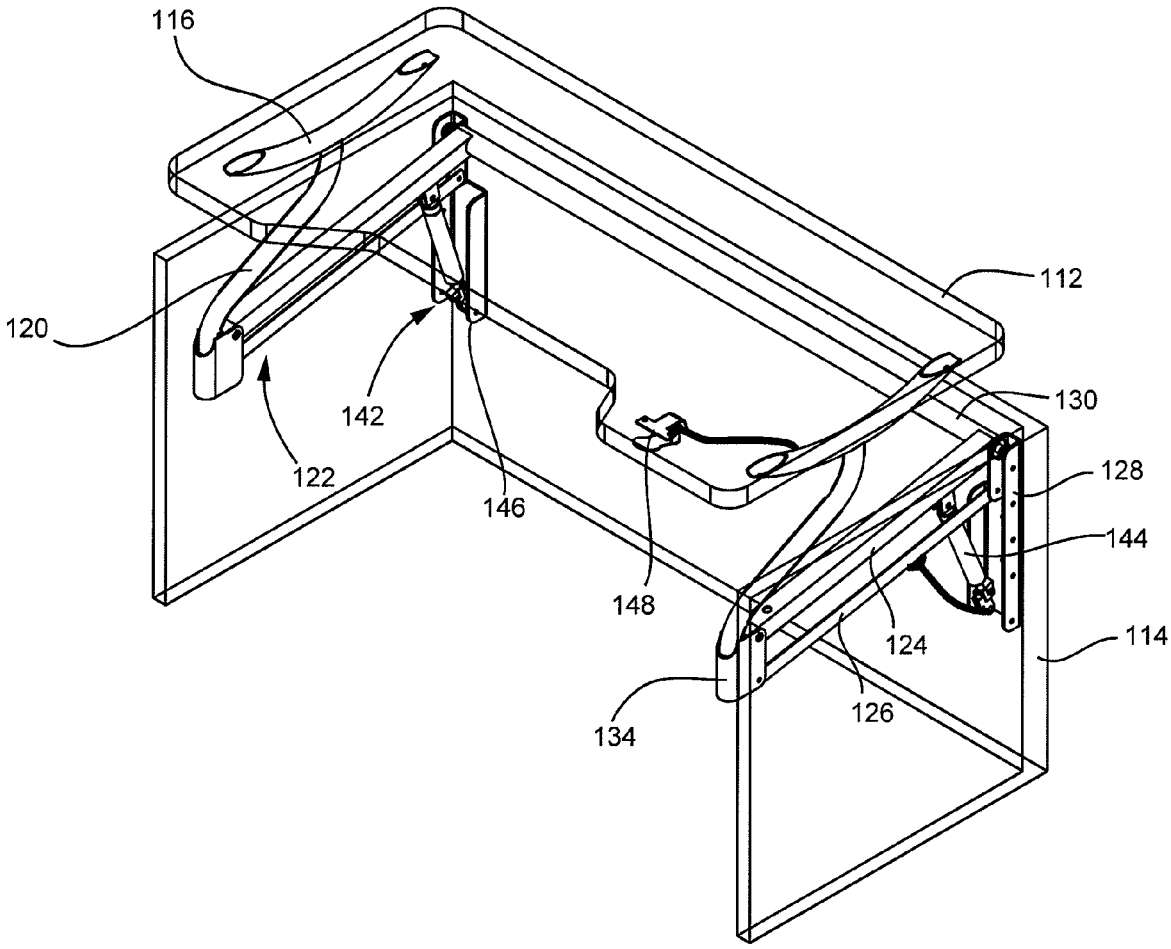
FIG. 9 is a perspective view of another embodiment of an adjustable work surface system.

In an alternative, a work surface system 100 may be designed to attach to a secure structure such as a freestanding desk 114, as shown in FIG. 9, or a modesty panel and the end gable. The desk may be retrofitted with the work surface system 100 or may be designed to be attached to a new desk top or work surface 112. The work surface 112 is attached to a work surface support on either side of the work surface 112. The work surface support includes top supports 116, which may be attached directly to the work surface 112 via fasteners such as bolts or screws or may be attached to the work surface indirectly through brackets such as rail brackets as described above. The work surface supports further include connector rods 120 extending from each the top support 116. The connector rod 120 is designed to curve and attach at a second end to an under-mount mechanism 122 via an attachment mechanism such as an attachment bracket 134. The under-mount mechanism 122 is a parallel arm mechanism having a support arm 124 and a connector arm 126. The under-mount mechanism 122 is preferably located on either side of the work surface 112 and pivots the work surface from a lowered position to a raised position through a parallel linkage system as described above.

The work surface system 100 is designed to mount to end gables of the freestanding desk and to the modesty panel with a mounting bracket 128. The mounting bracket 128 may be bolted or otherwise securely attached to the desk 114 in a vertical orientation. The mounting bracket could further be affixed to an office wall or office wall partition. In some cases, the mounting bracket may also be affixed in a horizontal orientation.

The under-mount mechanism 122 is further connected to a braking and lifting system 142 consisting of a gas lift 144, a lift bracket 146 and a lift system control mechanism 148. The lift bracket 146 may be integrated with the mounting bracket 128 to form a U-shaped bracket as shown in FIG. 9. In an alternative, the lift bracket may be a separate piece connected to the mounting bracket.

Figure 10:
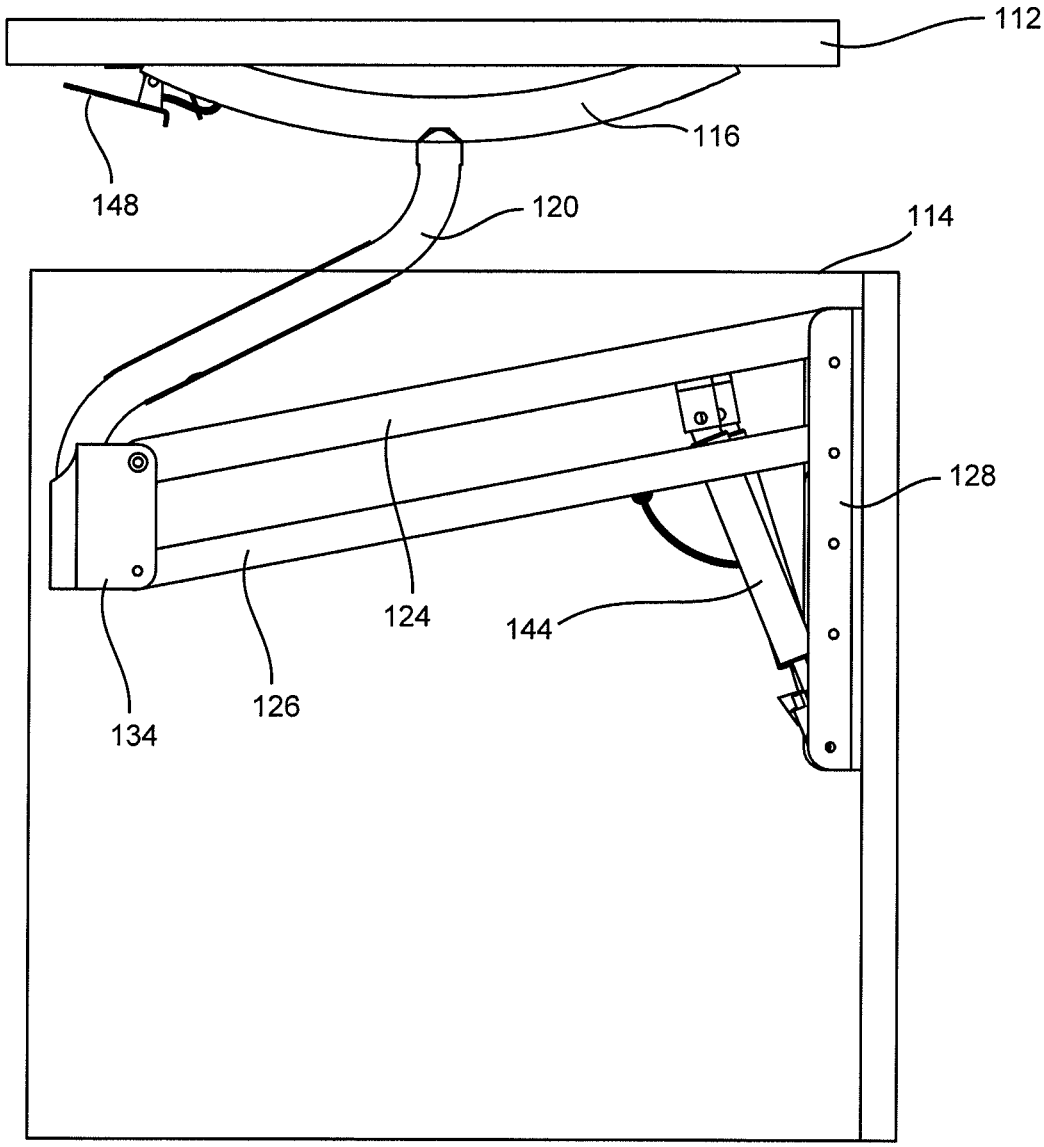
FIG. 10 is a side view of the adjustable work surface system of FIG. 9.

As shown in FIG. 10, the work surface system 100, can be raised above the height of the corresponding desk 114 walls. In some cases, the work surface system 100 may not include the additional components of the slideable relationship between the top support and the work surface or the guide and guide controller. As there is no extended back wall, there may not be a desire for there to be a gap between the work surface 112 and the desk back. It should be understood that these components are optional and are intended to keep the gap at an approximately constant size and could be incorporated if a user would like the work surface to remain in a more constant position when the work surface is raised and lowered by the under-mount mechanism.

The work surface or desktop maintains a horizontal or level position throughout the range of the height adjustment due to the arrangement of the under-mount mechanism as shown. The movement comprises substantially greater movement in the y-axis (movement up and down) that the x-axis (toward and away from the system panel). The x-axis movement is minimized to reduce any gap between the system panel and the work surface. By having the under-mount extend almost the full length of the work surface and with the pivot points away from the body of the under-mount construction, with the addition of a guide and a slidable top support, the resulting movement may be the desired y-axis lift with little x-axis movement.

In some cases, the work surface may be raised and lowered over a range of 18 inches. In other cases, the work surface may be raised and lowered over a range of 16 inches. In a specific case, the range for the change in position of the work surface in the y-axis is approximately 16 to 18 inches. The preferred range allows the work surface to be used either as a sit down work surface in its lowered position or as a stand up work surface in its raised position with other possible positions in between. The user may choose to have it positioned in an in between position depending on the user's height and seating arrangement. The range of motion between the lowest position and the highest position of the work surface is not restricted. It will be understood that with modifications to the arm lengths and lift provided by the gas lift, this range may be increased or decreased.

The work surface may be tilted through the use of a tilting mechanism. This is preferably achieved via a bolt or other mechanical system (not shown) in each of the top mounting brackets, which moves through a slot in these mounting brackets when the tilting mechanism is released. When the tilting mechanism is engaged or tightened, the work surface is locked into place.

The tilting mechanism allows for the plane of the work surface to be tilted towards the user so that he or she may have easier access at the work surface. The work surface may preferably be locked in a positive tilt of up to ten degrees although other angles are contemplated. The positive tilt may also reduce the stress on the user's back while he or she is doing paperwork or leaning over the work surface.

In an alternative, a wedge may be placed between the underside of the work surface and the top support, or the rail brackets 18. The wedge would provide a permanent slope that would preferably be 10 degrees, which is intended to be enough to roll a pencil and not enough to make a paper slide. It will be understood that the tilt may be modified by the slope of the wedge.

The above-described embodiments of the height adjustable work surface system are intended as examples only. Alterations, modifications and variations may be effected to the particular embodiments by those of skill in the art without departing from the scope, which is defined solely by the claims appended hereto.

What is claimed is:

1. A height adjustable work surface system for adjusting a height of a work surface comprising:

a work surface support mounted on an underside of the work surface, the work surface support including a top support member;

an attachment bracket;

a s-shaped tubular connecting rod connected at a first end to a mid-point of the top support member and at a second end to the attachment bracket, the attachment between the connecting rod and the attachment bracket near a front of the work surface system;

a mounting bracket for mounting the height adjustable work surface system to a vertical structure; and a dual-arm under-mount mechanism, the dual-arm under-mount mechanism pivotably attached at a first end to the mounting bracket and pivotably attached at a second end to the attachment bracket;

whereby pivoting of the dual arm under-mount mechanism allows the height of the work surface to be raised or lowered.

2. The height adjustable work surface system of claim 1 further comprising a lift system operatively connected to the dual-arm under-mount mechanism.

3. The height adjustable work surface system of claim 2 wherein the lift system includes a lift system control mechanism adapted to lock and unlock the lift system.

4. The height adjustable work surface system of claim 2 wherein the lift system includes at least one gas lift operatively connected to the dual-arm under-mount mechanism.

5. The height adjustable work surface system of claim 1 wherein the dual-arm under-mount mechanism comprises a support arm and a connector arm.

6. The height adjustable work surface system of claim 1 wherein the top support member is slideably attached to the work surface via rail brackets.

7. The height adjustable work surface system of claim 6 wherein the top support member is connected to the rail brackets via an attachment apparatus.

8. The height adjustable work surface of claim 7 wherein the attachment apparatus are clips.

9. The height adjustable work surface of claim 8 wherein the clips engage in a slideable relationship with the rail brackets.

10. The height adjustable work surface of claim 1 wherein the top support member is parallel to the work surface.

11. The height adjustable work surface system of claim 1 further comprising a guide, slideably connected to a guide controller, wherein the guide and guide controller are designed to keep the work surface in a proximate relationship with a system panel.

12. The height adjustable work surface system of claim 1 wherein the work surface may be raised and lowered a range of 12 to 18 inches.

13. The height adjustable work surface system of claim 1 wherein the mounting bracket is adapted to mount to a system panel.

14. The height adjustable work surface system of claim 1 wherein the mounting bracket is adapted to mount to a desk.

15. The height adjustable work surface system of claim 1 wherein the connector rod is connected to the top support member near a middle of the top support member.

16. The height adjustable work surface system of claim 1 wherein the dual arm mechanism comprises two arms.

* * * * *